US008601846B2

(12) United States Patent
Beltrán de Nanclares Echezarreta et al.

(10) Patent No.: US 8,601,846 B2
(45) Date of Patent: Dec. 10, 2013

(54) FIXED SUPPORT FOR A METAL SHEET DRAWING MACHINE

(75) Inventors: Eduardo Beltrán de Nanclares Echezarreta, Vitoria-Gasteiz (ES); David Chico García, Vitoria-Gasteiz (ES); Oscar González Mora, Donosita (ES); Daniel García Chueca, San Sebastián (ES)

(73) Assignee: Fagor, S. Coop, Mondragon (ES)

( * ) Notice: Subject to any disclaimer, the term of this patent is extended or adjusted under 35 U.S.C. 154(b) by 401 days.

(21) Appl. No.: 12/961,327

(22) Filed: Dec. 6, 2010

(65) Prior Publication Data

US 2011/0132061 A1 Jun. 9, 2011

(30) Foreign Application Priority Data

Dec. 4, 2009 (ES) ..... 200931121

(51) Int. Cl.
*B21D 11/02* (2006.01)

(52) U.S. Cl.
USPC ..... 72/302; 72/293

(58) Field of Classification Search
USPC ..... 72/237, 293, 295, 301, 302, 305, 311, 72/419, 420, 422
See application file for complete search history.

(56) References Cited

U.S. PATENT DOCUMENTS

| | | | | |
|---|---|---|---|---|
| 3,403,542 | A * | 10/1968 | Bova | 72/302 |
| 3,803,899 | A * | 4/1974 | Hertl et al. | 72/420 |
| 4,248,079 | A | 2/1981 | Specktor | |
| 4,576,030 | A * | 3/1986 | Roper | 72/296 |
| 4,751,838 | A | 6/1988 | Voges | |
| 6,065,318 | A * | 5/2000 | Maniwa et al. | 72/237 |
| 6,205,830 | B1 | 3/2001 | Voges | |
| 6,209,377 | B1 * | 4/2001 | Shore et al. | 72/248 |
| 6,460,391 | B1 * | 10/2002 | Liefer et al. | 72/302 |
| 7,607,330 | B2 * | 10/2009 | Casal et al. | 72/302 |
| 2008/0034827 | A1 | 2/2008 | Casal et al. | |

FOREIGN PATENT DOCUMENTS

| | | | |
|---|---|---|---|
| DE | 4437872 | C1 | 3/1996 |
| EP | 1923150 | A1 | 5/2008 |
| GB | 1172243 | A | 11/1969 |
| GB | 2446921 | A | 8/2008 |

OTHER PUBLICATIONS

Report on the State of the Art for National Patent Application No. 200931122 issued by the Spanish Office of Patents and Trademarks, dated Mar. 14, 2012, pp. 1-5.
Report on the State of the Art for National Patent Application No. 200931121 issued by the Spanish Office of Patents and Trademarks, dated Mar. 14, 2012, pp. 1-5.
Report on the State of the Art for National Patent Application No. 200931123 issued by the Spanish Office of Patents and Trademarks, dated Apr. 18, 2012, pp. 1-4.

* cited by examiner

*Primary Examiner* — Edward Tolan
(74) *Attorney, Agent, or Firm* — Tim L. Kitchen; Peter B. Scull; Hamilton DeSanctis & Cha LLP

(57) ABSTRACT

A fixed support for a metal sheet drawing machine. In one implementation the fixed support includes a window through which metal sheet to be drawn passes, and a holder which holds the metal sheet within the window as the metal sheet is drawn. The fixed support is stationary in relation to the drawing machine and includes a suspending structure that maintains a base of the fixed support a distance from any other surfaces during the sheet drawing process.

9 Claims, 2 Drawing Sheets

FIXED SUPPORT FOR A METAL SHEET DRAWING MACHINE

CROSS-REFERENCE TO RELATED APPLICATIONS

This application relates to and claims the benefit and priority to Spanish Patent Application P200931121, filed Dec. 4, 2009.

TECHNICAL FIELD

The present invention relates to machines for drawing metal sheets, and more specifically to fixed supports used in these types of machines.

BACKGROUND

Metal sheet used to create different-shaped pieces by means of, for example, pressing, stamping or forming, are typically provided in the form of cylindrical rolls or coils of metal. The coils must be uncoiled in order for the metal sheet to be handled and when this is done the sheet presents undulations and distortions that are detrimental to its subsequent treatment or handling. In order to solve this drawback the sheet to be unrolled must be handled by a straightening machine where most of the stresses are eliminated. These straightening machines generally comprise a plurality of rollers between which the sheet passes.

This process is suitable for cases in which the sheets comprise a limited thickness. If the thickness exceeds a certain value, the rollers required to eliminate the stresses are very large, making the elimination of stresses in this way difficult. In these cases a drawing machine is used and by means of which the sheet is drawn to eliminate the stresses. This method can also be used for sheets of limited thickness. A drawing machine generally comprises a fixed support and a moving support that moves in relation to the fixed support in a drawing process. Both supports comprise a window through which the metal sheet to be drawn passes, and holding means for holding the metal sheet during the process with the aim of ensuring it is drawn.

U.S. Pat. No. 4,751,838 discloses a drawing machine of this type, where the fixed support is mounted in a fixed manner to a floor. The machine comprises feet and arms that are fixed to the floor and to the fixed support itself to provide the fixed support with a firmer fixing. The feet are connected to the bottom part of the fixed support by means of additional bars, while the arms are fixed to the top end of the fixed support.

SUMMARY OF THE DISCLOSURE

In one implementation a fixed support is provided for use in sheet metal drawing machines. In one implementation the fixed support is fixed to the floor or another fixed structure and comprises a window through which a metal sheet to be drawn passes, and a holder for holding the metal sheet when it is being drawn.

In one implementation the fixed support also comprises a support structure fixed to each of its sides by means of a respective fastening area of each support structure, through which it is fixed to the floor, or another stationary structure, so that the base of the fixed support is disposed at a certain distance from the floor or any other structure that could impart a contact force upon the base.

By gripping of the fixed support and being firmly fixed to a floor or other stationary structure, the support structure securely fixes the fixed support relative to the drawing machine. The manner in which the fixed support is maintained stationary relative to the drawing machine results in no portion of the base of the fixed support coming into direct contact with the floor or any other structure along its perimeter. As a result, the bottom portion of the fixed support maintains an ability to vertically flex without the fixed support enduring load stresses against the flexion that originate from the base. Obviating or reducing load stresses against the flexion reduces stresses acting on the support structure that would act to weaken the fixed support. By reducing or obviating such stresses the useful life of the support structure is advantageously extended.

These and other advantages and characteristics will be made evident in the light of the drawings and the detailed description thereof.

According to one implementation a fixed support of a metal sheet drawing machine is provided, the fixed support comprising: a top portion, a bottom portion, a first side portion, and a second side portion opposite the first side portion, the top and bottom portions being joined by the first and second side portions, the bottom portion having a base, a window located between the top, bottom, first side and second side portions and extending between a first face and a second face of the fixed support, the window facilitating the passage of a metal sheet through the fixed support, a holder at least partially situated within the window that functions to hold the metal sheet firmly within the fixed support during a drawing of the metal sheet, a downward force being generated through the bottom portion of the support while the holder holds the metal sheet during the drawing of the metal sheet, and a suspending structure coupled to the first side portion and the second side portion that holds the fixed support in a stationary position relative to the drawing machine and in a manner that maintains the base of the bottom portion a distance away from any other surface that would otherwise induce an upward force on the base in response to the downward force if a contact between the base and the other surface were to exist.

DETAILED DESCRIPTION

Figure 1:
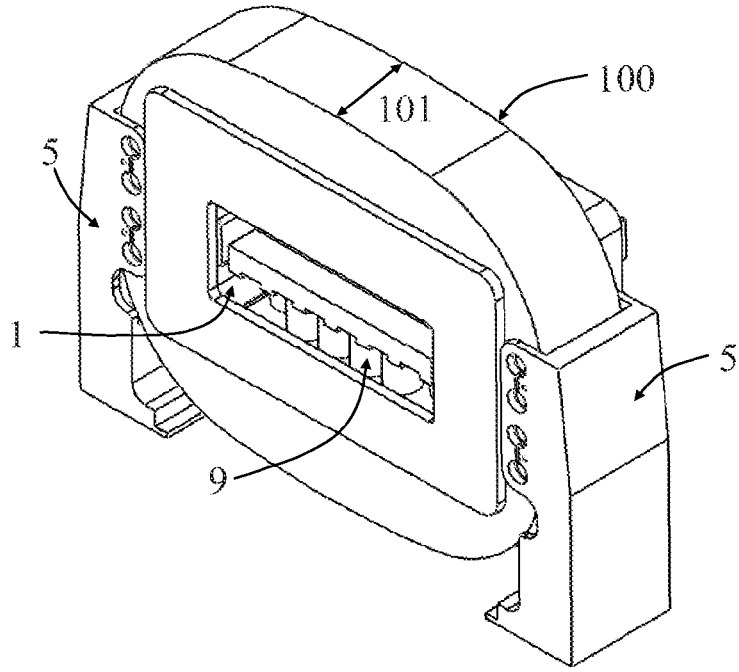
FIG. 1 shows a perspective view of a fixed support according to one implementation.
Figure 2:
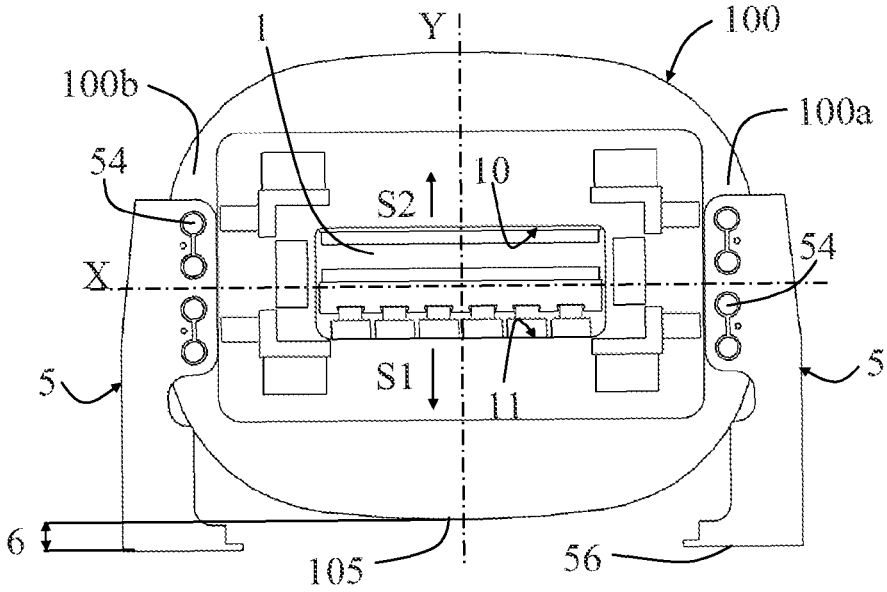
FIG. 2 shows a front view of the fixed support of FIG. 1.

FIGS. 1 and 2 show an implementation of a fixed support 100 of sheet metal drawing machine (not shown). The fixed support 100 is maintained stationary relative to the drawing machine by being fixed to a floor or other fixed structure. In one implementation the fixed support 100 includes a window 1 through which a metal sheet (not shown) to be drawn passes, and a holder 9 used to hold the metal sheet within the window 1 during a drawing process. In one implementation the holder is disposed on opposing surfaces 10 and 11 of the window 1, and comprises one or a plurality of cylinders on each of the surfaces 10 and 11 which act together like clamps to hold the metal sheet.

Figure 3:
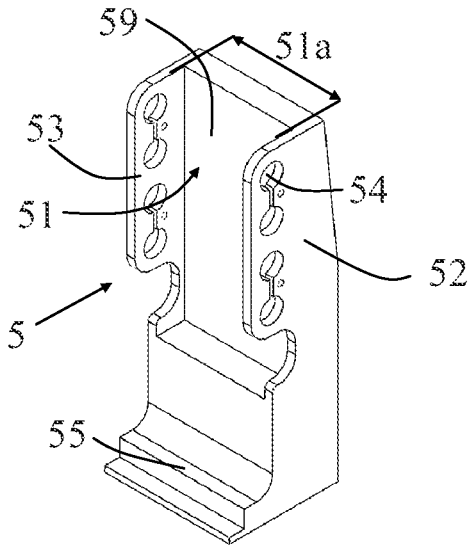
FIG. 3 shows a perspective view of a support structure of the fixed support of FIG. 1.

In one implementation the fixed support 100 comprises a support structure 5 fixed to each of its sides 100*a* and 100*b*, through which it is connected firmly to the floor or to another stationary structure and in a manner wherein the base 105 of the fixed support 100 is disposed at a certain distance of separation 6 from the floor or any other stationary structure. An exemplary support structure is illustrated in FIG. 3. In one implementation holder 9 comprises a plurality of cylinders that act to hold a portion of the metal sheet located within window 1 fixed while the metal sheet is being drawn. When activated, the holder 9 exerts vertical forces on the metal sheet in a direction which causes forces on the fixed support 100 in directions S1 and S2. The vertical forces can result in the flexion of the fixed support 100, the flexion being capable of affecting the metal sheet that is being drawn. By virtue of the support structure 5 continually suspending the base 105 of the fixed support 100 a distance from the floor, or any other structure, the fixed support 100 does not have to withstand forces that would otherwise act upon the base 105 in opposition to the force created by the holder 9 in the direction S1 if contact between the base 105 and any other structure along its perimeter were to occur. As previously discussed, in the event of having to withstand both forces acting in opposite direction, the fixed support 100 in the area that comprises the base 105 would experience stresses that could weaken its structure and cause it to fail prematurely.

In some implementations the fixed support is supported on at sides 100*a* and 100*b* by separate support structures 5. In other implementations a single unitary support structure is provided. In some implementations each of support structures 5 comprises a footing 55 with a flat fixing surface 56 useable to mount the support structures to a floor or other fixed structure by means of bolts, screws or other fixing means known in the art. In one implementation each support member 5 comprises an arm 52 that extends from the footing 55 to the side of the fixed support 100 to which it is fixed, preferably extending substantially vertically so that the space delimited by the support member 5 is limited, providing a compact fixed support 100 that is stable and also capable of withstanding major stresses.

In one implementation the arm 52 comprises a fastening area by means of which it is fixed to the fixed support 100. In one implementation the fastening area comprises a substantial U-shape space 51 with a width 51*a* that is equal to or slightly larger than the width 101 of the fixed support 100. In one implementation the fastening area includes two opposing walls or brackets 53 extending horizontally from the arm 52 and separated by a distance equal to or slightly larger than the width 101 of the fixed support 100. In one implementation the portion of the arm 52 extending between the brackets 53 is a solid wall 59. In such an implementation brackets 53 and wall 59 delimit the space 51. In some implementations each of brackets 53 has one or more commonly aligned through holes 54 that are aligned with at least one or more through holes (not shown) located in the side portions 100*a*, 100*b* of the fixed support 100. Pins, bolts, screws, or any other suitable types of fasteners positioned within the commonly aligned through holes of the support structure 5 and fixed support 100 act to secure the fixed support 100 to the support structure 5. In one implementation each of brackets 53 and each side 100*a*, 100*b* of fixed support 100 comprises the same number of through holes. Such support structures 5 and connection methods result in a fixed support 100 that is stably supported with a reduced risk of failure during a drawing a metal sheet.

In some implementations the fastening area is disposed substantially centred in relation to a horizontal axis X, the horizontal axis X corresponding with the virtual horizontal axis that divides the fixed support 100 into two halves, thereby providing a uniform fixing of the fixed support 100. As discussed above, in some implementations the fixed support 100 comprises two support structures 5, each support structure 5 being fixed to one side of the fixed support 100. In some implementations the support structures 5 have like structures and are fixed to the fixed support 100 symmetrically in relation to a vertical axis Y, the vertical axis Y corresponding with the virtual vertical axis that divides the fixed support 100 into two halves.

What is claimed is:

1. A fixed support of a metal sheet drawing machine, the fixed support comprising:

a top portion, a bottom portion, a first side portion, and a second side portion opposite the first side portion, the top and bottom portions being joined by the first and second side portions that each extend between the top and bottom portions, the bottom portion having a base, a window located between the top, bottom, first side and second side portions and extending between a first face and a second face of the fixed support, the window facilitating the passage of a metal sheet through the fixed support, a holder at least partially situated within the window that is moveable between a first vertical position and a second vertical position, the holder configured to hold the metal sheet stationary within the fixed support and to apply a downward force through the bottom portion of the support when in the first vertical position, in the second vertical position the holder is configured not to hold the metal sheet stationary within the fixed support; and a suspending structure coupled to the first side portion and the second side portion that holds the fixed support in a stationary position relative to the drawing machine and in a manner that maintains the base of the bottom portion a distance away from any other surface when the holder is activated to hold the metal sheet, the suspending structure comprising a first structure coupled to the first side portion and a second structure coupled to the second side portion, the first and second structures being fixed to the fixed support at locations substantially centred in relation to a horizontal axis of the fixed support, the horizontal axis corresponding with a virtual horizontal axis that divides the fixed support into two halves.

2. A fixed support according to claim 1, wherein each of the first and second structures respectively comprises a first arm and a second arm, the first arm coupled to the first side portion and the second arm coupled to the second side portion, each of the first and second arms comprising first and second opposing brackets, the width between the first and second opposing brackets being equal to or slightly greater than the width of the respective first and second side portions, the first and second brackets and respective first and second side portions having one or more commonly aligned apertures with pins or fasteners positioned therein to hold the fixed support to the suspending structure.

3. A fixed support according to claim 1, wherein the suspending structure comprises a footing attached to a floor.

4. A fixed support according to claim 2, wherein each of the first and second arms comprises a footing attached to a floor.

5. A fixed support according to claim 2, wherein the top portion and the bottom portion of the fixed support are spaced vertically from one another and the first and second side portions of the fixed support are spaced horizontally from one another.

6. A fixed support according to claim 3, wherein the top portion and the bottom portion of the fixed support are spaced vertically from one another and the first and second side portions of the fixed support are spaced horizontally from one another.

7. A fixed support according to claim 4, wherein the top portion and the bottom portion of the fixed support are spaced vertically from one another and the first and second side portions of the fixed support are spaced horizontally from one another.

8. A fixed support according claim 1, wherein the first and second structures are connected to the fixed support at symmetrical locations in relation to a vertical axis of the fixed support, the vertical axis corresponding with a virtual vertical axis that divides the fixed support into two halves.

9. A fixed support according claim 2, wherein the first and second arms are connected to the fixed support at symmetrical locations in relation to a vertical axis of the fixed support, the vertical axis corresponding with a virtual vertical axis that divides the fixed support into two halves.

* * * * *